US010587046B2

(12) United States Patent
Farzaneh et al.

(10) Patent No.: US 10,587,046 B2
(45) Date of Patent: Mar. 10, 2020

(54) WIDENED BEAMWIDTH FOR DIPOLE ANTENNAS USING PARASITIC MONOPOLE ANTENNA ELEMENTS

(71) Applicant: COMMUNICATION COMPONENTS ANTENNA INC., Kanata (CA)

(72) Inventors: Sadegh Farzaneh, Kanata (CA); Minya Gavrilovic, Kanata (CA); Nasrin Hojjat, Kanata (CA); Des Bromley, Kanata (CA)

(73) Assignee: COMMUNICATION COMPONENTS ANTENNA INC., Kanata, ON (CA)

( * ) Notice: Subject to any disclaimer, the term of this patent is extended or adjusted under 35 U.S.C. 154(b) by 0 days.

(21) Appl. No.: 15/578,261

(22) PCT Filed: May 31, 2016

(86) PCT No.: PCT/CA2016/050611

§ 371 (c)(1),
(2) Date: Nov. 30, 2017

(87) PCT Pub. No.: WO2017/020114

PCT Pub. Date: Feb. 9, 2017

(65) Prior Publication Data

US 2018/0166782 A1 Jun. 14, 2018

Related U.S. Application Data

(60) Provisional application No. 62/199,790, filed on Jul. 31, 2015.

(51) Int. Cl.
*H01Q 5/49* (2015.01)
*H01Q 19/10* (2006.01)
(Continued)

(52) U.S. Cl.
CPC ..... *H01Q 5/49* (2015.01); *H01Q 19/10* (2013.01); *H01Q 19/106* (2013.01);
(Continued)

(58) Field of Classification Search
CPC ..... H01Q 5/49; H01Q 19/106; H01Q 19/108; H01Q 21/26; H01Q 19/185; H01Q 19/10
See application file for complete search history.

(56) References Cited

U.S. PATENT DOCUMENTS 5,629,713 A 5/1997 Mailandt
6,195,063 B1 * 2/2001 Gabriel ..... H01Q 19/108 343/700 MS (Continued)

OTHER PUBLICATIONS

Wei et al., "Method for Broadening the Beamwidths of Crossed Dipoles for Wideband Marine GPS Applications, Progress in Electromagnetic Research Letters", 2009, pp. 31 to 40, vol. 12.

(Continued)

*Primary Examiner* — Hai V Tran
*Assistant Examiner* — Michael M Bouizza
(74) *Attorney, Agent, or Firm* — Sofer & Haroun, LLP

(57) ABSTRACT

Systems and devices relating to dipole antennas. The beamwidth of a crossed dipole antenna is widened by providing a parasitic monopole antenna adjacent to the crossed dipole antenna. In one configuration, each arm of the crossed dipole antenna has, adjacent to it, a parasitic monopole antenna. In another configuration, the crossed dipole antenna is surrounded by a number of other crossed dipole antennas acting as parasitic monopole antenna elements. The center or primary crossed dipole antenna can be for low band signals while the secondary crossed dipole antennas are for high band signals.

10 Claims, 10 Drawing Sheets

(51) Int. Cl.
*H01Q 21/26* (2006.01)
*H01Q 19/185* (2006.01)

(52) U.S. Cl.
CPC ..... *H01Q 19/108* (2013.01); *H01Q 21/26* (2013.01); *H01Q 19/185* (2013.01)

(56) References Cited

U.S. PATENT DOCUMENTS

| | | | | |
|---|---|---|---|---|
| 7,173,572 | B2 | 2/2007 | Teillet | |
| 7,868,842 | B2 * | 1/2011 | Chair | H01Q 21/26 343/797 |
| 2005/0237258 | A1 * | 10/2005 | Abramov | H01Q 3/24 343/834 |
| 2012/0146872 | A1 * | 6/2012 | Chainon | H01Q 1/523 343/818 |
| 2014/0043195 | A1 * | 2/2014 | Ho | H01Q 19/108 343/770 |

OTHER PUBLICATIONS

ISA/CA, International Search Report and Written Opinion for corresponding PCT International Application No. PCT/CA2016/050611, dated Jul. 19, 2016.

* cited by examiner

WIDENED BEAMWIDTH FOR DIPOLE ANTENNAS USING PARASITIC MONOPOLE ANTENNA ELEMENTS

TECHNICAL FIELD

The present invention relates to the field of telecommunications. More specifically, this invention relates to systems and devices for providing widened crossed dipole antenna beamwidth.

BACKGROUND

The field of antenna design is continuously adapting to the needs of the telecommunications industry. For some applications, multiple port antenna systems are desirable. Similarly, other applications may require not just multiple port antennas but also antennas which can be used for both high and low band frequencies. Finally, in other applications, antennas which can achieve specific beamwidths are required.

There are currently narrow band applications for antennas with four ports that can achieve 90 degree azimuth beamwidth. It has been suggested that increasing the height of a dipole antenna will increase azimuth beamwidth. Unfortunately, this technique cannot be applied to hex-port antennas. Firstly, increasing the height of the high band dipole to achieve 85 to 90 degree beamwidth generates a strong resonance in the low band spectrum. This resonance severely degrades the low band antenna pattern. Secondly, increasing the height of the low band dipole antenna increases the depth of the antenna. Finally, increasing the height of the high band and low band dipoles increases the cost of the antenna.

In another approach, it has been suggested that an 85 to 90 degree beamwidth can be achieved by using a small reflector, proper fencing, and by stacking the antenna columns. However, this method results in multi-column antennas that are impractically tall.

There is therefore a need for systems and devices which mitigate if not overcome the shortcomings noted above.

SUMMARY

The present invention provides systems and devices relating to dipole antennas. The beamwidth of a crossed dipole antenna is widened by providing a parasitic monopole antenna adjacent to the crossed dipole antenna. In one configuration, each arm of the crossed dipole antenna has, adjacent to it, a parasitic monopole antenna. In another configuration, the crossed dipole antenna is surrounded by a number of other crossed dipole antennas acting as parasitic monopole antenna elements. The center or primary crossed dipole antenna can be for low band signals while the secondary crossed dipole antennas are for high band signals.

In a first aspect, the present invention provides an antenna system comprising:

- a primary antenna subsystem comprising a pair of primary antenna dipoles, each primary antenna dipole having a pair of elongated arms;
- a plurality of secondary antenna subsystems, each secondary antenna subsystem being located adjacent to said primary antenna subsystem;

wherein said pair of primary antenna dipoles are crossed dipoles;

each of said plurality of secondary antenna subsystems operate as parasitic monopole antennas.

In another aspect, the present invention provides an antenna system comprising:

- at least one dipole antenna having outwardly extending arms;
- at least one monopole antenna adjacent an arm of said at least one dipole antenna;

wherein said at least one monopole antenna operates as a parasitic monopole antenna for said at least one dipole antenna.

BRIEF DESCRIPTION OF THE DRAWINGS

The embodiments of the present invention will now be described by reference to the following figures, in which identical reference numerals in different figures indicate identical elements and in which.

The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention.

DETAILED DESCRIPTION

Figure 1A:
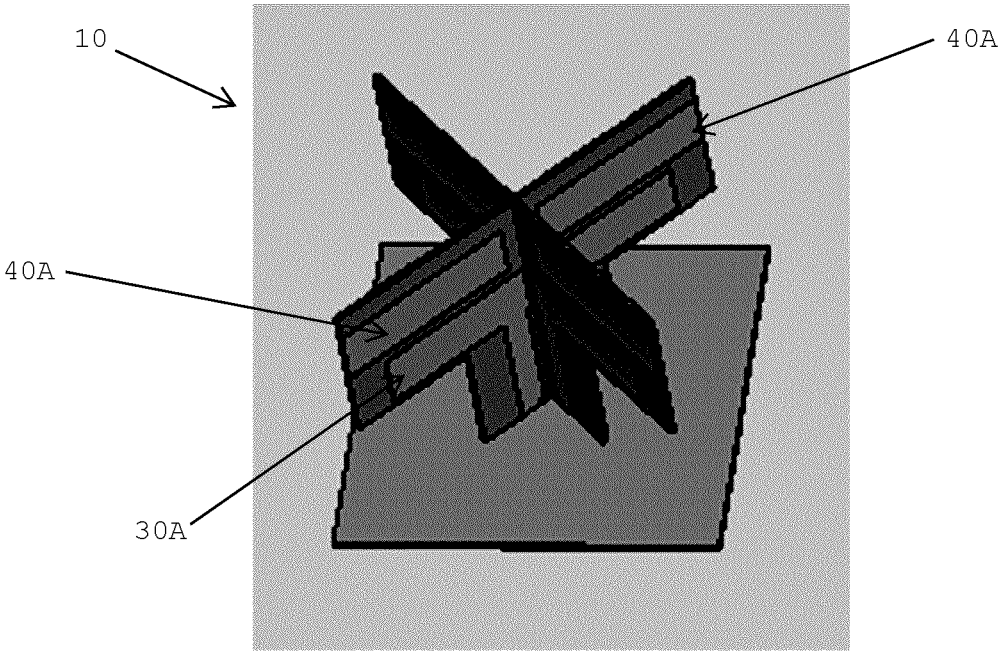
FIG. 1A is an isometric view of crossed dipoles for high band frequencies.
Figure 1B:
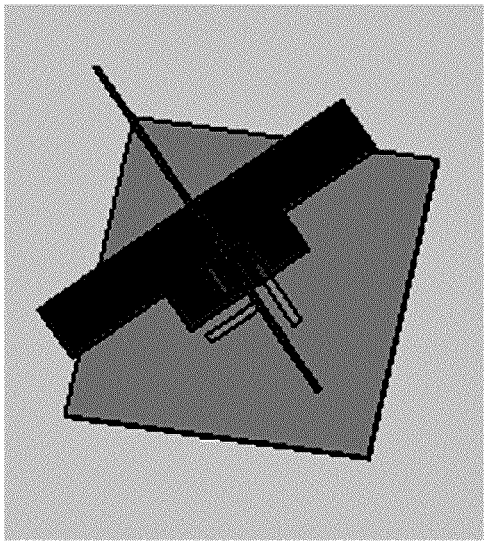
FIG. 1B illustrates the crossed dipoles from FIG. 1A in a balun view.
Figure 2A:
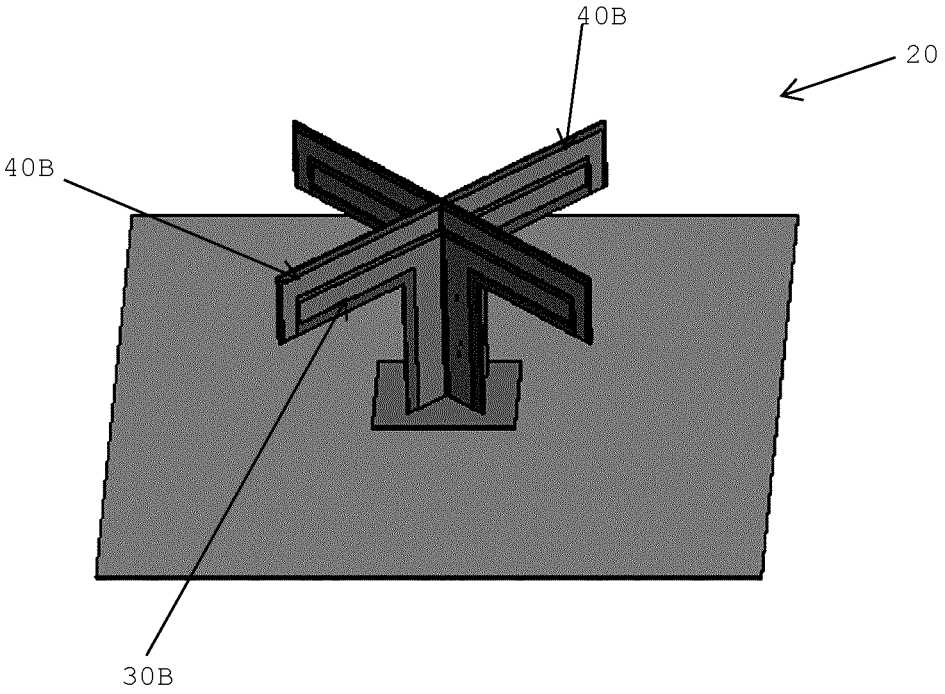
FIG. 2A is an isometric view of crossed dipoles for low band frequencies.
Figure 2B:
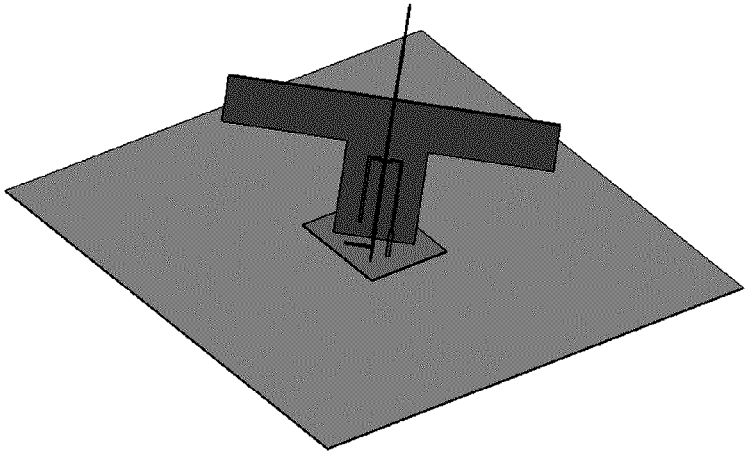
FIG. 2B is a balun view of the crossed dipole antenna illustrated in FIG. 2A.

Referring to FIGS. 1A and 1B, a high band dipole antenna 10 is illustrated. Referring to FIGS. 2A and 2B, a low band dipole antenna 20 is illustrated. FIGS. 1A and 2A illustrate isometric views of the antennas while FIGS. 1B and 2B illustrate balun views of the respective antennas.

As can be seen from FIGS. 1A and 2A, each dipole antenna has an angled trace 30A, 30B of conductive material on a suitable rigid backing. For the high band dipole antenna, an extra conductive trace 40A is located above and parallel to the angled trace 30A. This angled trace 30A can be termed the lower branch of the dipole antenna. For the low band dipole antenna, an extra conductive trace 40B is also located above the angled trace 30B. For this conductive trace 40B, the trace is also parallel and above the angled trace 30B. As well, the conductive trace 40B also has a downwardly angled section that abuts the arm of the angled trace 30B.

To widen the beamwidth of the dipoles in FIGS. 1 and 2, each crossed dipole assembly can be surrounded by 4 parasitic capacitive shorted monopole antennas as shown in FIG. 3. Parasitic monopole antennas create an omnidirectional beam in the plane of the reflector that has a null in the main beam direction of dipoles. By controlling the height and location of parasitic monopole antennas the level of current induced in them and their resonance frequency is determined. The combination of dipole radiation and monopole radiation is a widened beam. The closer the monopole antennas are to the dipole antennas, the wider is the resulting azimuth beam. Parasitic monopole antennas can be, in a preferred implementation, primarily four slotted line antennas located at the four edges or at the end of the arms of a dipole antenna for best performance (see FIG. 3A). However, the monopole antennas can also be a small wire or strip shorted directly to the reflector. Similarly, the small wire or strip can be capacitively shorted to the reflector. Such a monopole antenna is illustrated in FIG. 3B.

Figure 3A:
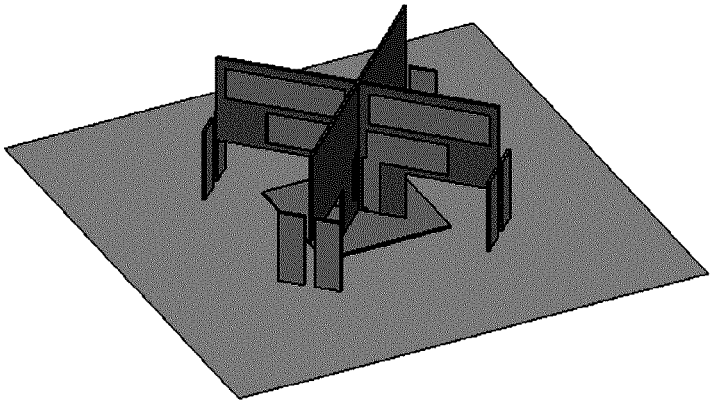
FIG. 3A illustrates a crossed dipole antenna with slotted line parasitic monopole antennas.
Figure 3B:
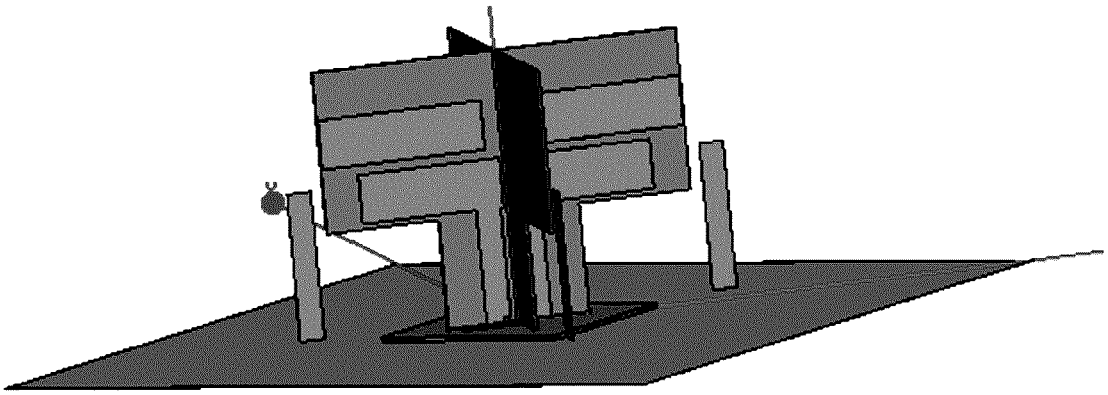
FIG. 3B illustrates a crossed dipole antenna with wire monopole antennas coupled to the reflector.
Figure 3C:
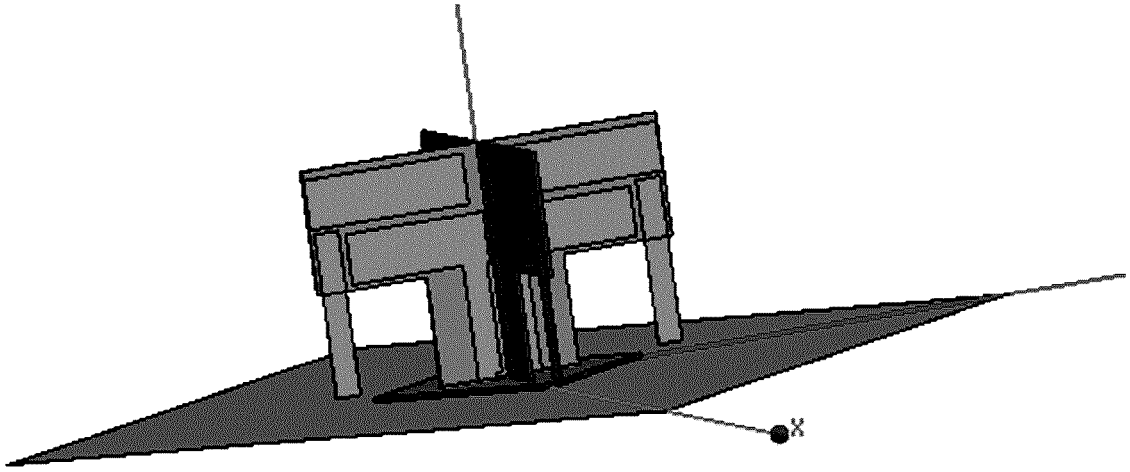
FIG. 3C shows a crossed dipole antenna with floating parasitic monopole antennas.
Figure 3D:
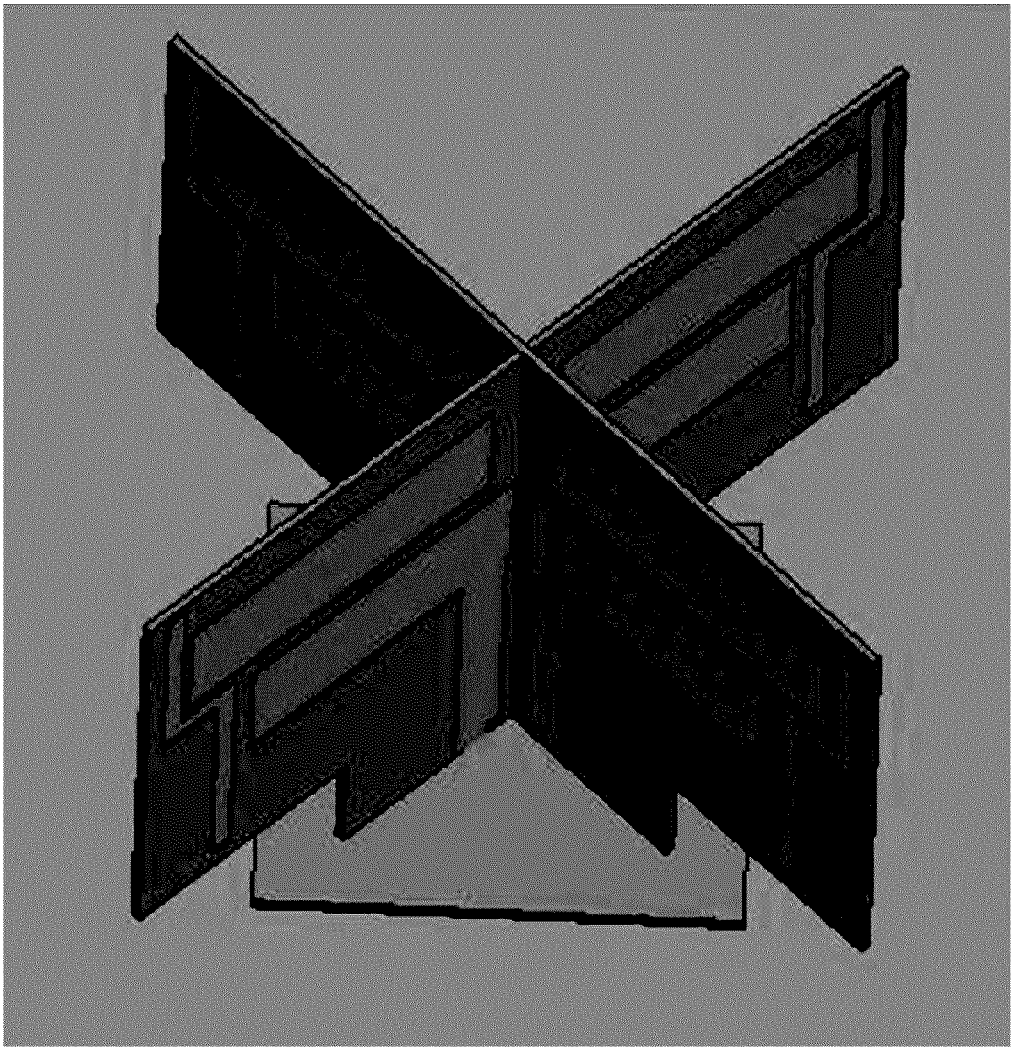
FIG. 3D shows a crossed dipole antenna with integrated parasitic monopole antennas.

It should be noted that the monopole antennas can be a wire or a strip floating above the reflector (see FIG. 3C). Alternatively, the monopole antennas can be strips integrated with the dipole antenna (see FIG. 3D).

For clarity, while FIGS. 3A-3D illustrate a high band dipole antenna, low band antennas can also be used. Similarly, while FIGS. 3A-3D show four parasitic monopole antennas located at the edge or at the end of the dipole antenna arms, there can be any number of monopole antennas and these monopole antennas need not be located at the end of the dipole antenna arms. There can be more or less than 4 monopole antennas and they can be located anywhere near the dipole antenna. It should also be clear that the center dipole antenna can be considered to be the primary antenna while the parasitic monopole antennas can be considered as secondary antennas.

It should also be clear that, while the above discussion relates to crossed dipole antennas, the concept of broadening a dipole antenna's beamwidth through the use of parasitic monopole antennas is also applicable to single dipole antennas. Thus, dipole antennas that are not in a crossed format (i.e. non-crossed dipole antennas) may also be used with parasitic monopole antennas to result in a broadened beamwidth for the dipole antenna.

Figure 4:
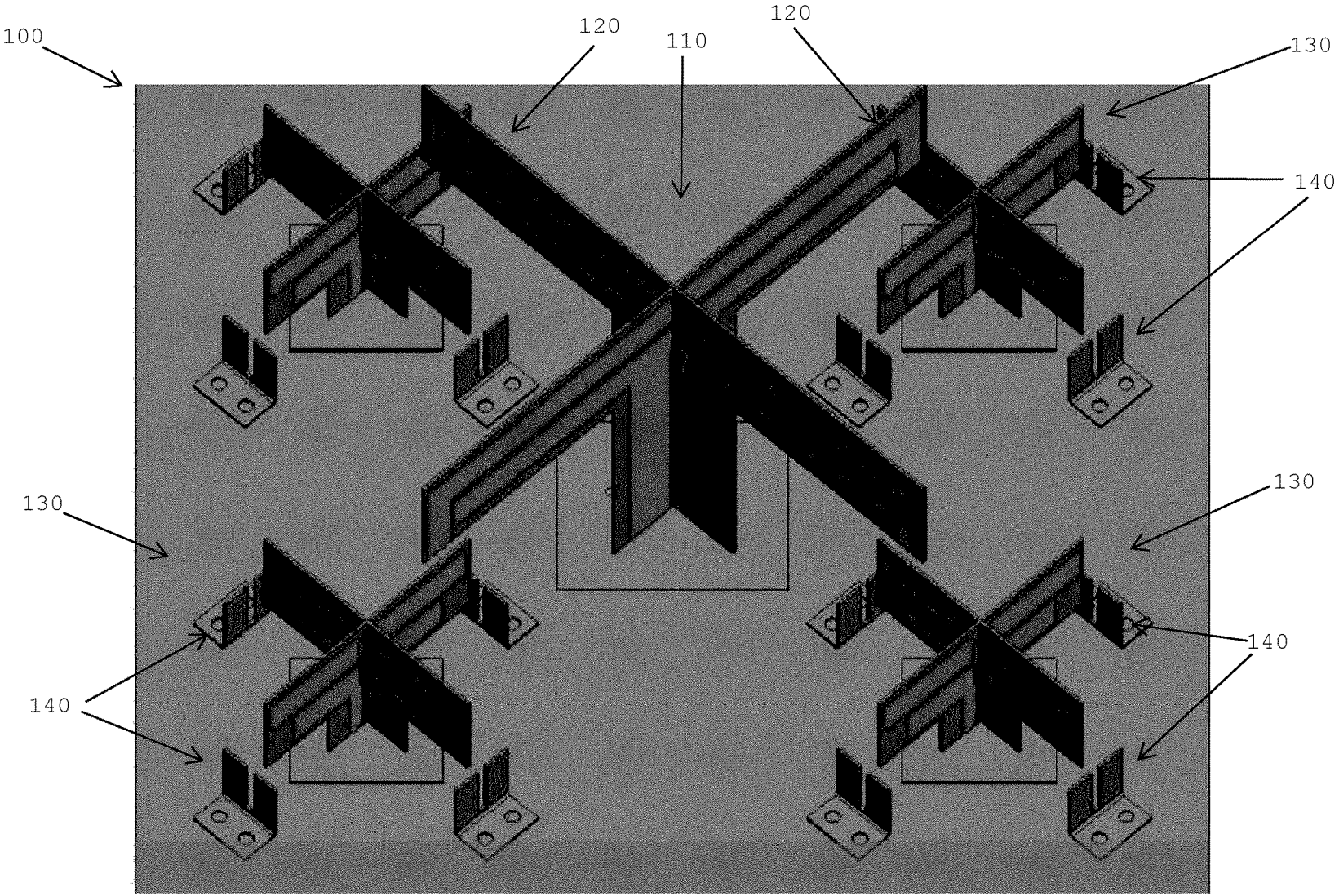
FIG. 4 depicts a six port antenna system with a low band dipole antenna surrounded by four high band dipoles antennas, the high band dipole antennas each having slotted line monopole antennas.

While the above discusses the use of simple parasitic monopole antennas to broaden the beamwidth of a center dipole antenna, more complex antennas, which operate as parasitic monopole antennas, can also be used. Referring to FIG. 4, an antenna system 100 has a primary dipole antenna 110 with arms 120 at the center of the system 100. Located at the end of each arm 120 is a secondary dipole antenna 130. Each one of the secondary dipole antennas 130 is also equipped with parasitic monopole antennas 140 located at the edges of its arms 150. For the secondary dipole antennas, the parasitic monopole antennas are simple slotted line monopole antennas. It should be clear that, in one implementation of the system 100, the primary center dipole antenna is a low band antenna while the secondary dipole antennas are high band antennas which operate as parasitic monopole antennas. The configuration in FIG. 4 allows for a wider beamwidth for the low band dipole antenna.

The antenna system in FIG. 4 has a configuration of 2×2 high band antennas and 1×2 low band antenna on the same reflector and can be called a hex-port antenna. In this antenna system, there is one dipole column for each 1×2 ports (+/−45 polarization). Preferably, the three antenna columns are integrated side by side to reduce the antenna height and overall system footprint. It should be noted that, in most implementations of the hex-port antenna system, the high band and low band dipoles strongly affect each other. In particular, the high band dipole antennas (also referred to as the secondary antennas) act as parasitic monopole antennas and this increases the beamwidth of the low band antenna (also referred to as the primary antenna). This phenomenon can be taken advantage of to control the low band azimuth beamwidth.

In the antenna system of FIG. 4, it should be clear that if the high band dipole antennas are not designed properly, they can drastically degrade the low band pattern. It is preferred that the high band dipole antennas be designed not only to work properly in high band but also to act as proper parasitic elements for the low band antenna to thereby achieve an 85/90 degree beamwidth for the low band frequencies. One main aspect of the high band dipole antennas is that each secondary dipole antenna's height should be reduced so that its quarter-wave resonant height is outside of the low band frequency spectrum.

It should be clear that the terms "high band" and "low band" refer to frequency bands for the signals being received or transmitted through the antenna systems and devices discussed in this document. High band frequencies can include 1695-2690 MHz or any frequencies within this range such as 1695-2180 MHz or 1695-2360 MHz. For low band frequencies, the frequency range covers 698-960 MHz, including any narrower bands such as 698-896 MHz.

Regarding implementation details, such as dipole antenna height, high band dipole antennas used for a system which covers 1710-2360 MHz as high band frequencies and which covers 698-894 MHz as low band frequencies were configured to be $0.16\lambda_0$ tall where $\lambda_0$ is the high band center frequency wavelength. It should be clear that the term "height" refers to the spacing from reflector to the center of main dipole branch. For this implementation, since the height being measured is for the high band dipole antenna, then this distance is from the reflector to the center of the high band dipole antenna. For this implementation, this height is shorter than a normal high band dipole antenna which is, generally, $0.25\lambda_0$.

It is another challenge to design high band dipole antennas which are shorter than quarter wave length, has broadband operation, and has the proper pattern specifications. Since it is the height and length of the high band lower dipole branch (the angled portion of the dipole antenna) that determines the resonance in low band frequencies, the height and length of the high band dipole antenna are reduced to move this resonance out of the low band frequencies. By doing so, the dipole resonant frequency is shifted higher than the center frequency for that dipole. However, by bringing the dipole antenna closer to ground, impedance variation is high and this makes it difficult to match impedances. By adding another parasitic above the main dipole branch with a larger length, another resonance is created in the lower part of the frequency band. For clarity, this parasitic can be seen as trace 40A in FIG. 1A. Furthermore, the balun for the dipole antenna can be designed to have two quarter length line sections which improve bandwidth matching. Finally, the whole dipole and parasitic monopole systems can be tuned in the lab to provide the required bandwidth.

Figure 5:
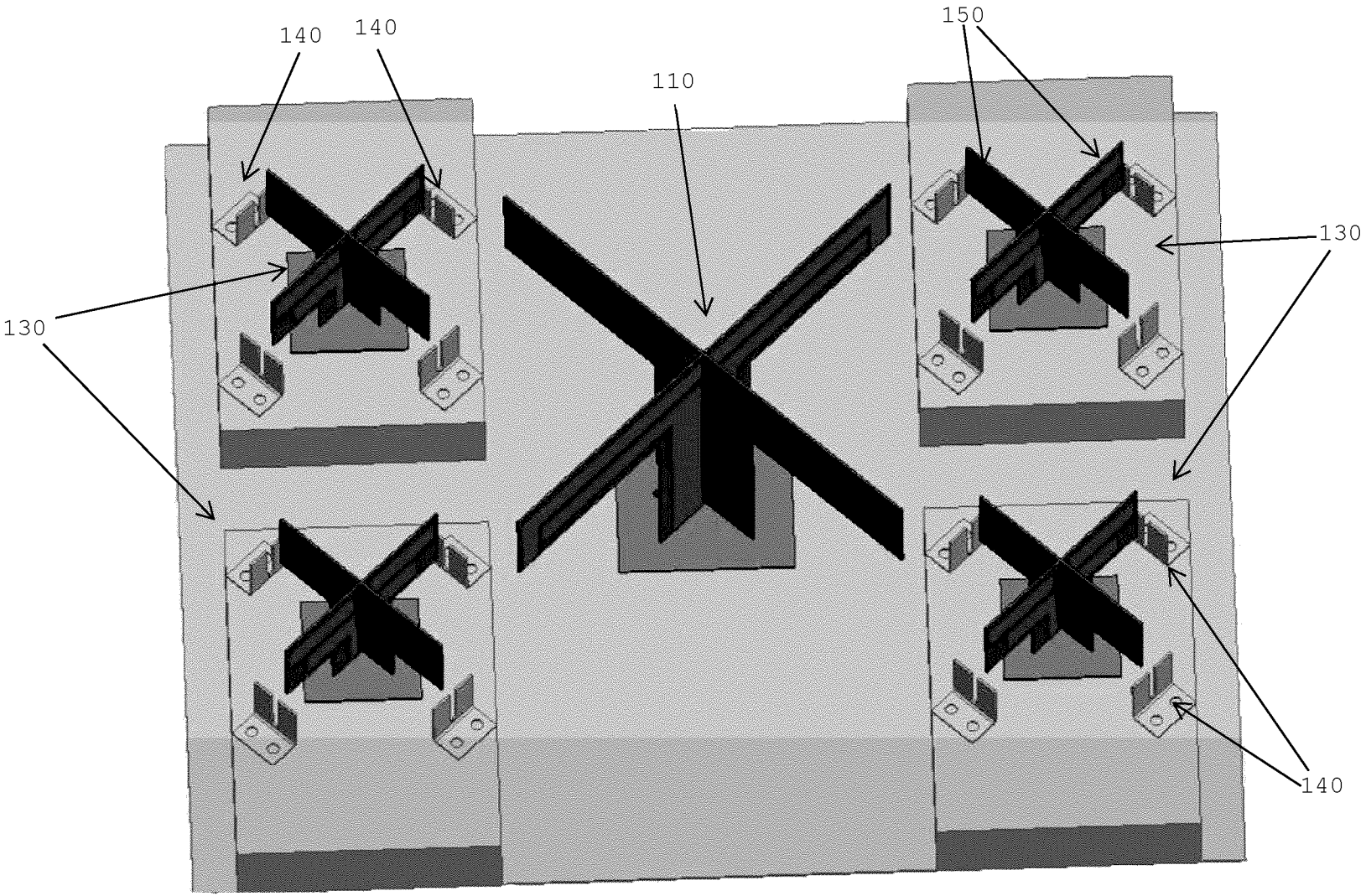
FIG. 5 depicts the antenna system illustrated in FIG. 4 with the four high band dipole antennas elevated on a ridge.

Referring to FIG. 5, the antenna system illustrated in FIG. 4 is again illustrated but with the secondary dipole antennas being located atop a ridge.

To accommodate the low band 90/85 beamwidth, the high band dipole height spacing from the reflector is preferably reduced to less than a quarter wavelength of the high band frequency. For clarity, this dipole height is the distance from the dipole antenna center to the reflector. By using the high band dipole and the parasitic monopole concept, the high band dipole antennas can be designed to provide 85/90 degree beamwidth for the low band signal. However, when high band columns are moved to the reflector edge or to the two sides of low band dipole antenna, the pattern is distorted at some frequencies and tilts due to the asymmetric reflector. To overcome this effect, the system illustrated in FIG. 5 was designed.

In the system of FIG. 5, the high frequency band columns are located on a ridge with the proper height. In one implementation, the ridge height is determined to be approximately $0.1\lambda_0$-$0.25\lambda_0$ where $\lambda_0$ is the center frequency wavelength depending on the antenna requirements. As noted above, the height of a dipole antenna is the distance from the center of the main dipole branch to the reflector. Having high band dipoles on the ridge also reduces the impact of B band dipoles.

In one implementation of the invention, the resulting antenna system provides an 85/90 degree azimuth beamwidth for both the low band and the high band frequencies. The resulting dual broadband hex-port antenna has dual slant +/−45 degree polarization with an 85 degree beamwidth. For the primary antenna, two dipole elements are arranged in a crossed format to create dual polarization for each low frequency band. Two antenna ports cover the 698-960 MHz band and four antenna ports cover the 1710-2690 MHz band. To achieve the 85/90 degree beamwidth for the high band frequencies, each high band crossed dipole antenna (the secondary antennas) is surrounded by four shorted monopoles. To achieve the same 85/90 azimuth beamwidth for the low band frequencies, each crossed low band dipole is surrounded by four high band dipole antennas which act as parasitic monopole antenna elements. The high band dipole antennas are carefully designed to work for the high frequency band and to act as proper parasitic monopole antennas for the low frequency band. Each high band antenna element is surrounded by 4 monopole antennas with proper height to create an 85/90 degree beamwidth. There are two columns of high band antennas and one column of low band antennas in the structure in FIG. 5.

It should be clear that the high band dipole antennas in FIGS. 4 and 5 can first be adjusted/designed to operate as parasitic monopole antennas to thereby increase the beamwidth for the low band frequencies. Once this is done, these high band dipole antennas can then be adjust to operate as high band antennas. Simple parasitic monopole antennas can be added to the high band antennas to thereby broaden the beamwidth of the high band antennas.

Figure 6:
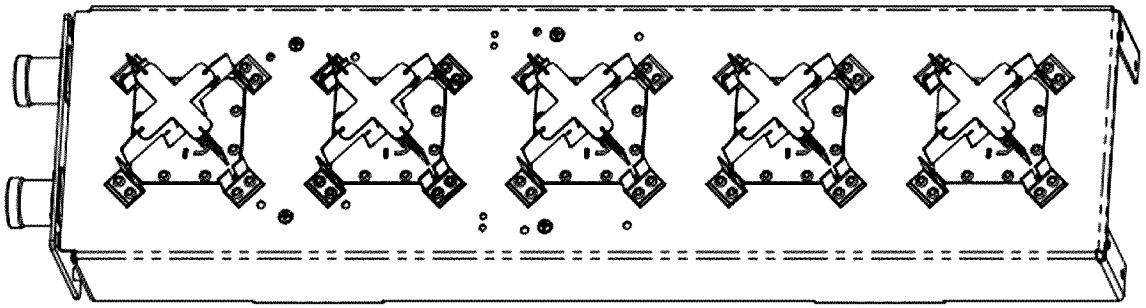
FIG. 6 illustrates an antenna array having 5 instances of one implementation of the present invention.
Figure 7:
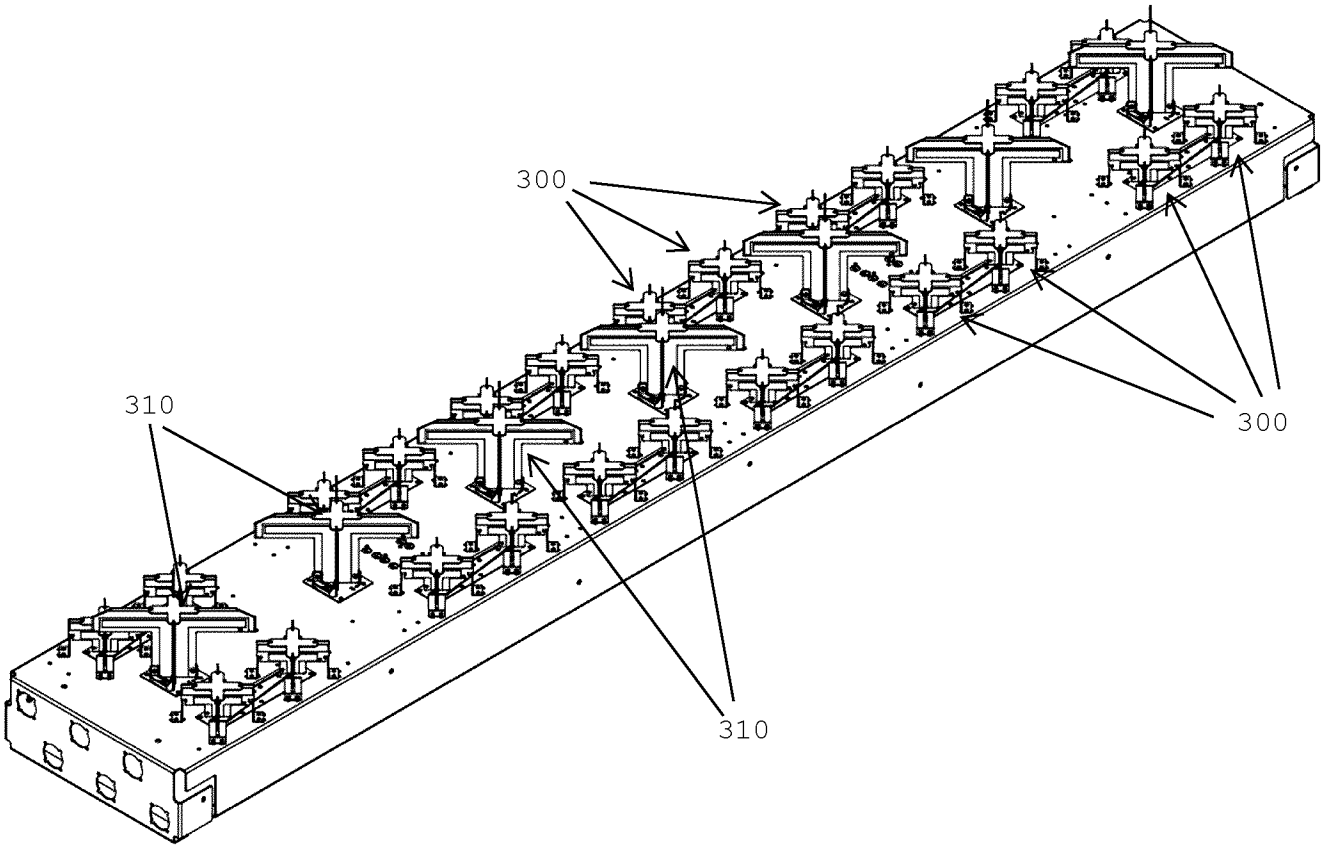
FIG. 7 shows an antenna array with multiple instances of the hex port antenna illustrated in FIG. 4.
Figure 8:
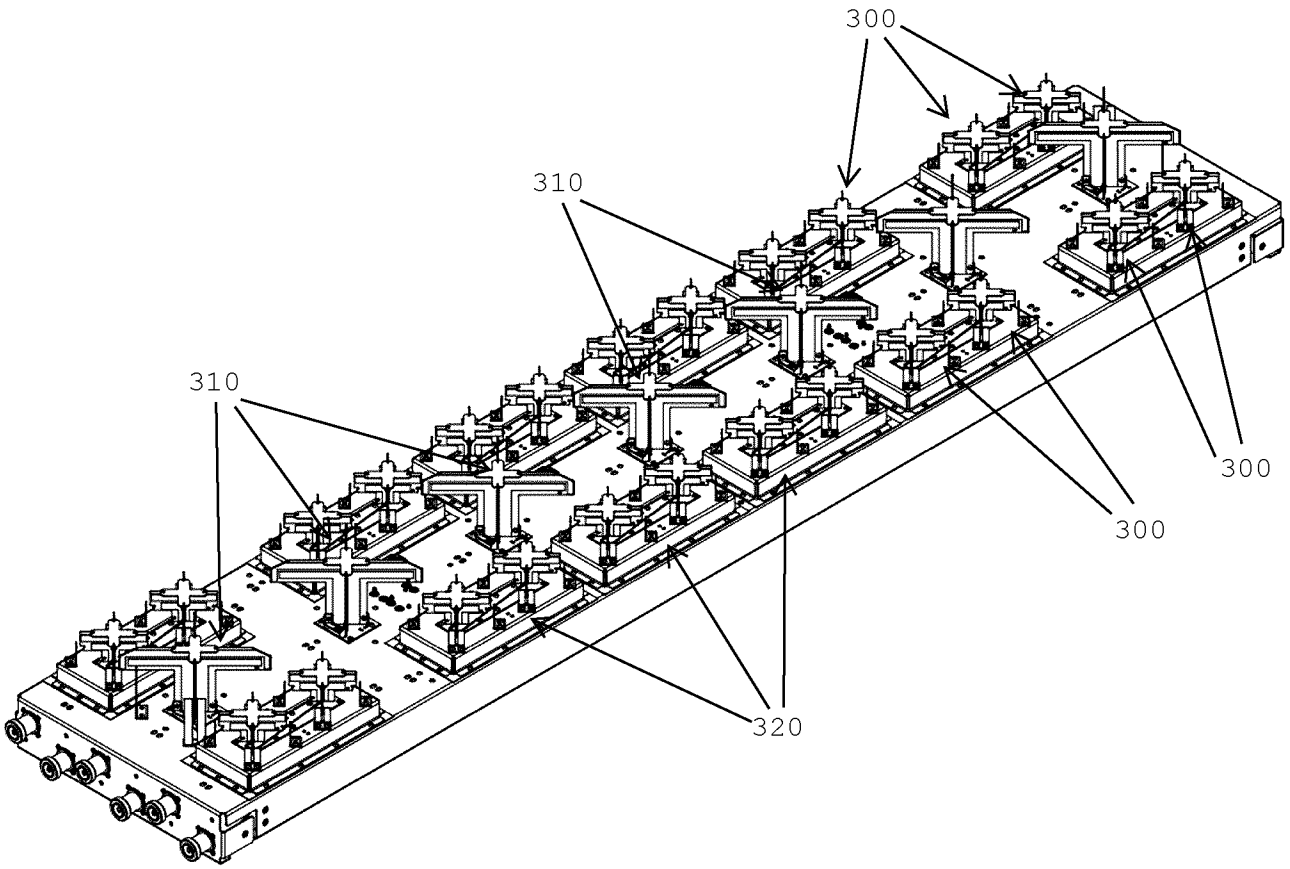
FIG. 8 shows an antenna array with multiple instances of the hex port antenna illustrated in FIG. 5.

Referring to FIGS. 6-8, different configurations of antenna arrays which use different implementations of the invention are illustrated. FIG. 6 depicts an antenna array with five high band antenna elements with 85/90 degree azimuth beamwidth. This antenna array is a 2-port, one dimensional array using suitably designed crossed dipoles with parasitic monopole antennas to result in an antenna with a 90 degree azimuth beamwidth covering 1710-2690 MHz. As the antenna is a single band antenna, dipole antenna height is allowed to be quarter wavelength of the center frequency.

FIG. 7 shows a six-port antenna array based on the concept shown in FIG. 4 with low and high band dipole antennas loaded with parasitic monopoles. Each high band antenna array (arrayed on the longitudinal axis of the system) is composed of twelve high band antenna elements 300 which are divided in groups of two antenna elements per group. The low band array is in the center of the system and has seven antenna elements 310. In one implementation, this antenna system covers 1710-2360 MHz and 698-896 MHz bands.

FIG. 8 is similar to FIG. 7 in that it illustrates a six port antenna array. However, the antenna array in FIG. 8 is based on the concept illustrated in FIG. 5. In FIG. 8, the high band dipole antennas are mounted on the ridges 320. Other configurations of the antenna array are, of course, possible.

It should be clear that the present invention may be used for other frequency bands. Dipole antennas, whether in a crossed configuration or not, can have their beamwidths increased by using parasitic monopole antennas. For antenna systems designed for dual-band operation, depending on the frequency bands, high band dipole antennas might not act as proper parasitic monopoles for low band frequencies. In such situations, actual parasitic monopole antennas, such as those discussed above, can be added.

A person understanding this invention may now conceive of alternative structures and embodiments or variations of the above all of which are intended to fall within the scope of the invention as defined in the claims that follow.

We claim:

1. A dual band antenna system comprising:

a primary antenna subsystem comprising a pair of primary antenna dipoles, each primary antenna dipole having a pair of elongated arms said primary antenna subsystem operating in a first desired frequency band for transmitting and receiving communication signals;

a plurality of secondary antenna subsystems, each secondary antenna subsystem-comprising a dipole being located near an end of an elongated arm of a primary antenna dipole of said primary antenna subsystem said plurality of secondary antenna subsystems operating in a second desired frequency band for transmitting and receiving communication signals said second desired frequency band being different from said first desired frequency band; wherein said pair of primary antenna dipoles are crossed dipoles; and each of said plurality of secondary antenna subsystems also operate as parasitic monopole antennas so as to increase the beamwidth of radiation pattern of said primary antenna subsystem.

2. An antenna system according to claim 1, wherein each one of said plurality of secondary antenna subsystems corresponds to a single elongated arm of one of said pair of primary antenna dipoles.

3. An antenna system according to claim 1, further comprising at least one slotted line structure is located near an elongated arm of one of said secondary antenna subsystems said slotted line structure operates as a parasitic monopole antenna so as to expand the beamwidth of said secondary antenna subsystem.

4. An antenna system according to claim 3, wherein slotted line structure comprises a conductive strip shorted to a reflector plane of said antenna system.

5. An antenna system according to claim 4, wherein said at least one of said plurality of secondary antenna subsystems slotted line structure is capacitively shorted to said reflector.

6. An antenna system according to claim 4, wherein said slotted line structure is directly shorted to said reflector.

7. An antenna system according to claim 1, wherein at least one of said secondary antenna subsystems comprises a crossed dipole antenna structure and at least one parasitic monopole adjacent to said at least one secondary antenna subsystem.

8. An antenna subsystem according to claim 7, wherein said primary antenna subsystem is used for low frequency signals and said secondary antenna subsystems are used for high frequency signals.

9. An antenna subsystem according to claim 8, wherein a quarter wave resonant height of said secondary antenna subsystem is outside of a low frequency spectrum for said primary antenna subsystem.

10. An antenna subsystem according to claim 9, wherein said plurality of secondary antenna subsystems comprise four secondary antennas each having a crossed dipole structure and each operating as a parasitic monopole antenna for said high frequency signals, each of said secondary antennas crossed dipoles being located at an end of an elongated arm of a primary antenna dipole.

* * * * *